United States Patent [19]

Brent

[11] 4,418,793

[45] Dec. 6, 1983

[54] LADDER AID DEVICE

[76] Inventor: William E. Brent, 1 Forest Hill Dr., Taylors, S.C. 29687

[21] Appl. No.: 253,201

[22] Filed: Apr. 13, 1981

[51] Int. Cl.[3] ..... E06C 7/14

[52] U.S. Cl. ..... 182/129; 182/116; 248/238

[58] Field of Search ..... 182/129, 106, 116; 248/210, 238

[56] References Cited

U.S. PATENT DOCUMENTS

| | | | |
|---|---|---|---|
| 656,946 | 8/1900 | Corduan | 182/106 |
| 2,222,078 | 11/1940 | Kroeger | 182/129 |
| 3,139,154 | 6/1964 | Ewald | 182/129 |

FOREIGN PATENT DOCUMENTS

| | | | |
|---|---|---|---|
| 627519 | 9/1961 | Canada | 182/129 |

*Primary Examiner*—Reinaldo P. Machado
*Attorney, Agent, or Firm*—Dority & Flint

[57] ABSTRACT

An accessory aid device for a stepladder is disclosed which includes a sleeve 22 which is affixed to a ladder leg and a shank 28 corresponding in shape received in the sleeve which will slide but not rotate therein. A set screw 30 is received in a thickened wall 32 of the sleeves and positively sets the position of shank 28 which supports a utility shelf 34 for holding tools and the like and for aiding in the positioning of articles for overhead mounting.

2 Claims, 5 Drawing Figures

LADDER AID DEVICE

BACKGROUND OF THE INVENTION

The invention relates to utility ladders of the type commonly referred to as stepladders and to an accessory device which may be attached to the ladder as an aid to the worker in holding tools and other items and in performing other functions to aid the worker.

Commonly, a worker will step up and down the ladder many times when working from the ladder on overhead projects since there is little platform or shelf space on the ladder for supporting and holding tools and the like. While a foldable shelf is normally provided on the stepladder which folds outwardly from the rear legs for supporting a paint can and the like, this platform is not conveniently accessible to the worker when he is on the uppermost steps of the ladder and such generally has little other utility.

The present invention has as its objective the provision of a utility shelf or tray which is attached to a side leg of a stepladder to assist in holding articles which may be adjusted in its height relative to the ladder. The utility tray may hold a paint can, a paint roller pan, work tools, and may be advantageously made as a container for holding nuts and other small articles which often fall off of the top platform of the ladder when the ladder vibrates such as during hammering.

The purpose of the ladder aid device is also to provide a vertically adjustable platform and support which serves as a positioning aid in mounting certain objects overhead or to the ceiling.

SUMMARY OF THE INVENTION

According to the invention, the objectives of the invention are accomplished by providing a tubular sleeve which is attachable to a side leg of a stepladder and a correspondingly shaped tubular member which is slideably received in the sleeve and may be adjusted and set at a variety of verticle positions. A utility platform is carried by the support member which may include upturned side edges for retaining small articles.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
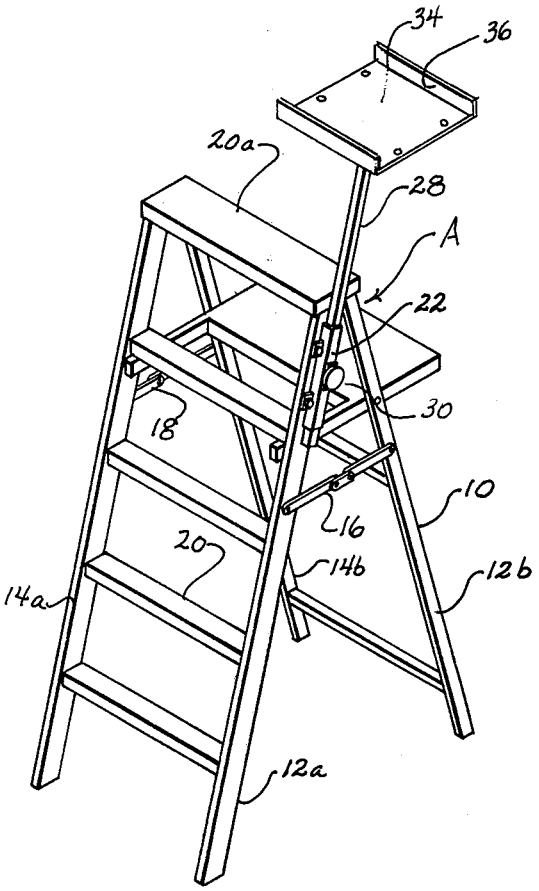
FIG. 1 is a perspective view illustrating the combination of a stepladder and an accessory device for aiding a worker constructed according to the present invention.

The invention relates to an accessory device for a stepladder which aids the worker in handling tools and work materials, and which aids in positioning objects overhead.

Referring now in more detail to the drawing, an accessory device, designated generally as A, is disclosed for a stepladder 10 which is of the type having pairs of opposed side legs 12 and 14. Side legs 12 include front leg 12*a* and rear leg 12*b* and the same for the opposing side 14*a* and 14*b*. Foldable braces 16 and 18 unfold to brace between the respective front and back side legs of each side to maintain the ladder in a free upstanding configuration. The ladder includes a plurality of platform steps 20 and a top platform 20*a*.

The accessory device which is utilized as a ladder aid is disclosed as including sleeve means 22 having an elongated bore 24 extending centrally therethrough open at distal ends of the sleeve. Attachment means for affixing the sleeve means to one of the legs is provided by the ears 26 extending outwardly from the sleeve 22 which include an opening 26*a* through which a bolt may be received for securing same to the ladder by means of a nut on the opposite end of the bolt extending through a ladder leg. A support member 28 is slideably received in the bore of the sleeve means and interlock means for fixing the relative position of the support member axially in the sleeve 22 is provided by means of a set screw 30. For purposes of positively locking the supporting member 28 in the sleeve, an added thickness of material 32 is provided which provides for more threads for the set screw 30 to be threaded into to provide a more positive and tighter thread lock against the support member 28.

A tray means is carried by the support member for supporting tools and related items and sheeting materials such as plywood and sheetrock. As illustrated, the tray means is provided in the form of a rectangular tray 34 having two upwardly bent side edges 36 and being open on the other two ends so that an elongated article may be supported on the tray. Two removable sides 36*a* may be attached to the tray which form a container for containing small articles such as nuts and bolts and nails. The tray means may be supported in a plurality of verticle positions to support and position at a desired height.

In a preferred embodiment, the bore of the sleeve means is defined by walls 24*a* which intersect one another at well defined angles. The support member 28 includes an elongated shank portion generally corresponding in shape with the elongated bore which has surfaces 28*a* which intersect each other at complimentary angles to the well defined angles of the bore walls so as to prevent turning of the shank in the bore. If the shank were allowed to turn or twist relative to the sleeve bore when the tray was under a heavy load, possible stripping or loosening of Kthe set screw would occur and the subsequent collapse of the tray. The planar surface 34 of the tray means is generally parallel with the top platform 20*a* of the ladder so that when the ladder is upstanding, the platform of the tray presents a horizontal support surface.

The set screw arrangement for locking the shank of the support member in the bore is preferred since it provides an infinite adjustability of the axial positioning and setting of the support member. This allows the aid device to hold items against the ceiling for mounting in the manner of a vise and for holding other heavy articles in a position for mounting such as when installing an electric ballast in a fluorescent lighting fixture.

In commercial applications, it may be desirable to attach two of the accessory ladder aid devices one on each side of the ladder so that the devices may support heavy loads in a balanced manner. An electrical box may also be attached to the tray means of the ladder aid device for using extension cords.

Figure 1A:
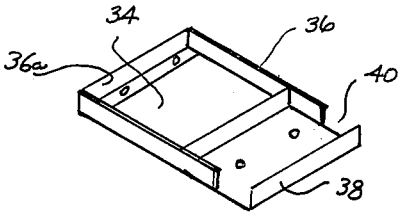
FIG. 1*a* shows a utility tray comprising a box like container and a side compartment for supporting elongated tools.
Figure 2:
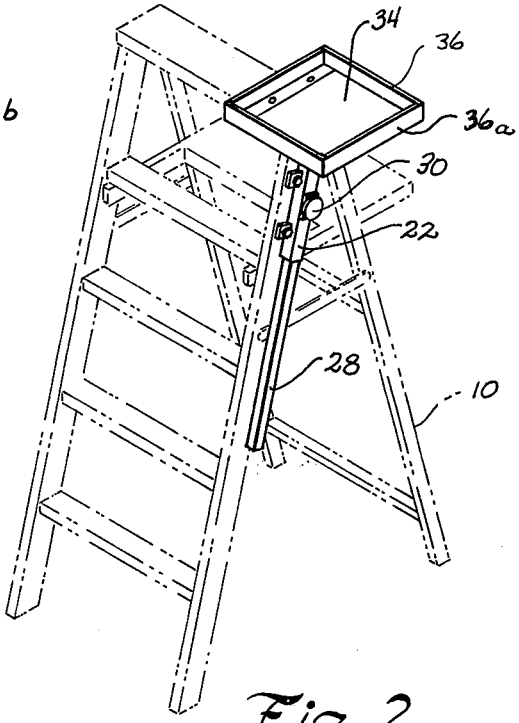
FIG. 2 is a perspective view illustrating the accessory ladder aid device flush with the top ladder platform.
Figure 3:
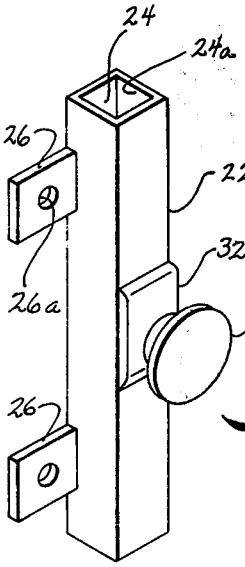
FIG. 3 is a perspective view of the sleeve member for an accessory device for a stepladder which attaches to the stepladder leg according to the present invention.
Figure 4:
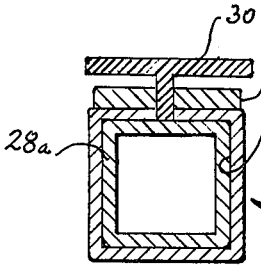
FIG. 4 is a cross-section view of the tubular sleeve and support member according to the invention.

FIG. 1*a* illustrates the utility tray as including an attachable side compartment 38 attached to platform 34 to define an open side slot 40 in which an elongated tool such as a hammer may be laid while the remaining tray compartment may be used for nails.

While a preferred embodiment of the invention has been described using specific terms, such description is for illustrative purposes only, and it is to be understood that changes and variations may be made without departing from the spirit or scope of the following claims.

What is claimed is:

1. In combination with a stepladder of the type having pairs of opposed side legs which pivot from a top platform of the ladder and foldable braces which unfold to brace between front and back side legs to maintain said ladder in a free upstanding configuration, an accessory device comprising:

sleeve means having an elongated bore extending therethrough open on distal ends of said sleeve means;

attachment means for fixably attaching said sleeve means to one of said ladder legs;

a support member slidably received in said bore of said sleeve means;

said bore of said sleeve means being defined by walls which intersect one another at well defined angles;

said support member including an elongated shank portion generally corresponding in shape with said elongated bore, said shank portion having surfaces intersecting each other at complementary angles to the defined angles of said elongated bore so as to prevent said shank portion from turning in said bore;

interlock means for fixing the position of said support member in said sleeve means;

tray means carried by said support member for supporting a work article and the like;

said tray means and including an open top tray having side walls forming a box and a side portion having a wall with a slot therein for receiving and holding elongated tools and being supportable in a plurality of positions to support said article at a desired height;

said interlock means setting and fixing said support members at an infinite number of continuous positions over the length of said support member facilitating adjustment of said support member to hold an article supported on said tray means firmly against an associated structure in a clamping manner.

2. The device set forth in claim 1 wherein said interlock means includes a set screw threadably received in a thickened wall portion of said sleeve means thickened relative to the other walls of said sleeve means.

* * * * *